United States Patent [19]

Hogg et al.

[11] 3,964,606

[45] June 22, 1976

[54] PACKAGE, DISPLAY AND DISPENSING DEVICE AND BLANK THEREFOR

[75] Inventors: James W. Hogg; Donald E. Burton, both of Nashville, Tenn.

[73] Assignee: Anchor Wire Corporation of Tennessee, Goodlettsville, Tenn.

[22] Filed: Mar. 31, 1975

[21] Appl. No.: 565,729

[52] U.S. Cl. ..... 206/395; 206/409; 229/8

[51] Int. Cl.[2] ..... B65D 85/671; B65D 85/04

[58] Field of Search ..... 206/395, 408, 389, 409; 229/8, 21

[56] References Cited

UNITED STATES PATENTS

| | | | |
|---|---|---|---|
| 2,964,227 | 12/1960 | Goldsholl | 229/21 |
| 3,343,743 | 9/1967 | Hamilton, Jr. et al. | 229/8 |
| 3,402,501 | 9/1968 | Davis | 206/408 |

*Primary Examiner*—William T. Dixson, Jr.
*Attorney, Agent, or Firm*—Eugene Sabol

[57] ABSTRACT

The invention is concerned with a package and dispensing device for a spool having material wound thereon to prevent inadvertent unwinding of the material yet permit easy access to the material for dispensing when desired. The device comprises first and second main panels connected to each other along the top and bottom thereof, a closing flap at each side of each main panel and connected thereto by arcuate fold lines, the outer edge of each flap being arcuate, one said flat at each side being folded inwardly on one said arcuate fold line and having its outer arcuate edge engaged against the inside surface of the opposite main panel, and the other flap at said side overlying the last mentioned flap whereby said flaps form concave side walls, one of said main panels having a window therein, and a spool having material wound thereon positioned between said main panels and between said concave side walls, adjacent said window which permits removal of said material from said spool. The invention is also concerned with a blank from which said device is made.

10 Claims, 4 Drawing Figures

FIG. 1
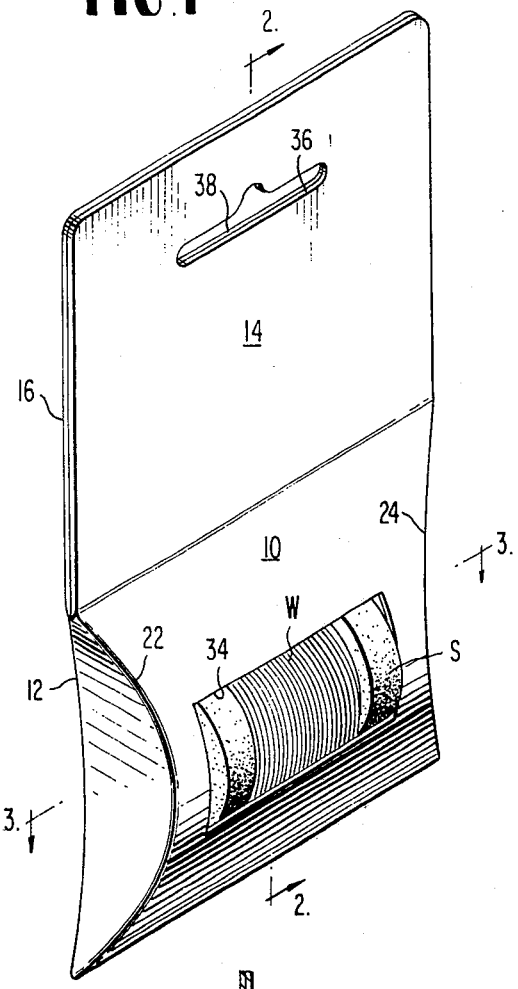
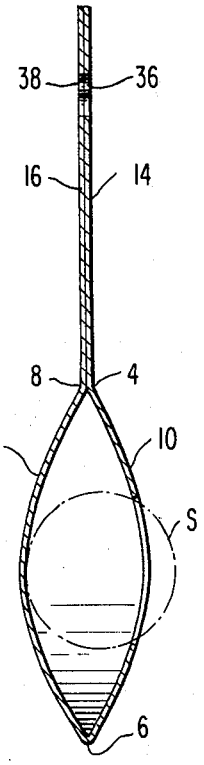
FIG. 2
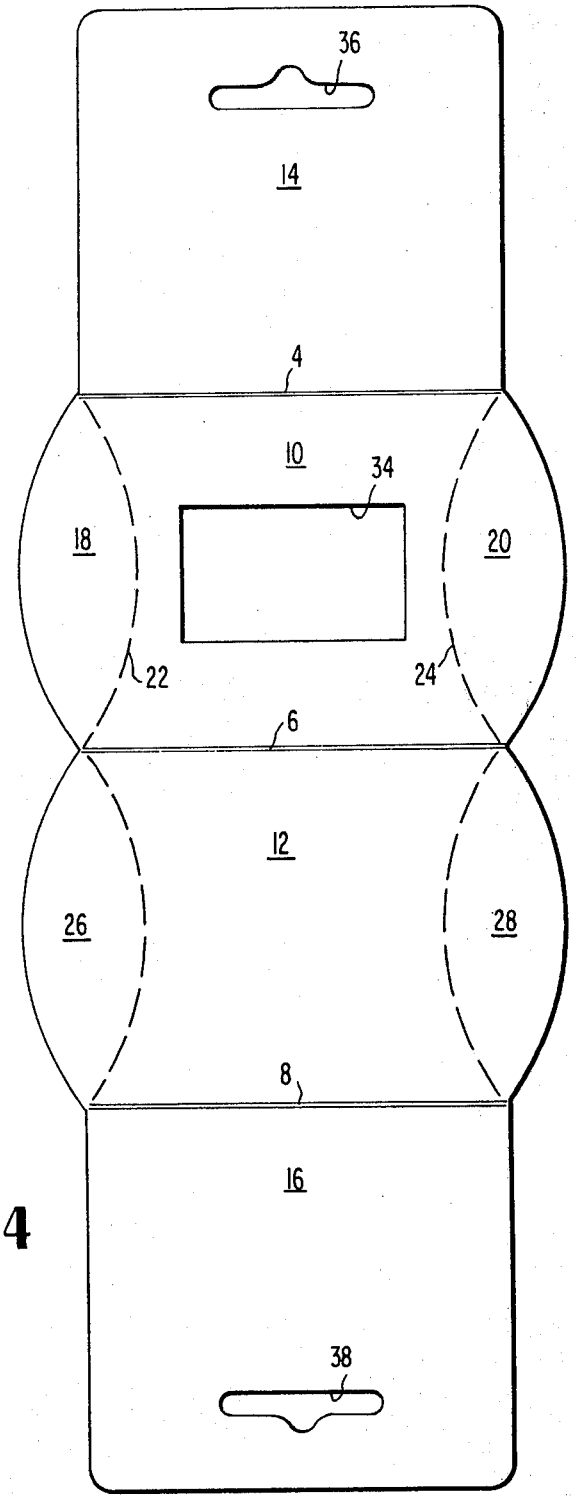
FIG. 4
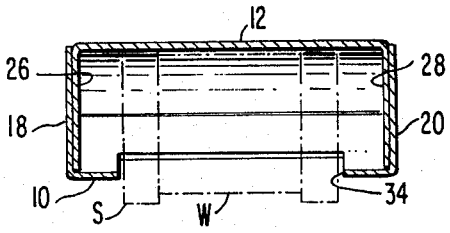
FIG. 3

PACKAGE, DISPLAY AND DISPENSING DEVICE AND BLANK THEREFOR

The invention is directed to a package and dispensing device for a spool having a material, such as wire, thread, or other elongate material, wound thereon and to blanks from which such devices can be made.

In the distribution, sale and use of spools of elongate materials, such as wire, thread, cord, string, etc., there has been the problem of the material inadvertently unwinding to result in a hopeless tangle in some cases. In the case of thin wire on a spool, e.g., 24 guage copper wire, the problem is compounded by the tendency of the wire to "squirrel-cage" which results even more in a tangled mess. Due to the springiness of the copper wire it tends to spring out in various directions while it is unwinding resulting in a three-dimensional tangle of wire which is substantially impossible to untangle.

While various solutions have been attempted none have proven to be satisfactory. For example, in some cases a slit or notch is placed in the rim of the spool. It is intended that the thread or wire be inserted into the slit or notch and held there by the resiliency and friction of the wood or other material from which the spool is made. However, in many cases the wood or other material splits off thus eliminating the notch and allowing the wire or thread to unwind and become entangled. Other solutions have been attempted but none have been found to satisfactorily solve the problem.

It is, therefore, a principal object of the invention to provide a package and dispensing device which will eliminate the problem of inadvertent unwinding of material wound on spools and resultant tangling of the material. It is also an object to provide a single and inexpensive packing device which will attractively display the material wound on the spool and permit dispensing of the material without removing the spool from the package.

It is another object of this invention to provide a single and inexpensive package and dispensing device which will display the material wound on a spool, permit the easy dispensing of said material while the spool remains in the package, and provide means for easily storing the package.

A further object is to provide a package and dispensing device which will prevent unwinding and tangling of the material wound on the spool even if the spool is inadvertently dropped or otherwise mishandled.

Another object of the invention is the provision of a package and dispensing device which has built-in gripping areas and which has means for providing increased control of material wound on the spool contained thereby.

It is a further object to provide a package and dispensing device having ample areas for presenting instructional information as well as identifying information.

Another object is to provide a package and dispensing device which can be made from a single blank of flat packing material such as cardboard, paper, paperboard and the like.

In the drawing forming part of this disclosure:

FIG. 1 is a pespective view of one embodiment of the device in accordance with this invention illustrated as containing a spool and material wound thereon.

FIG. 2 is a section on line 2—2 of FIG. 1.

FIG. 3 is a section on line 3—3 of FIG. 1, and

FIG. 4 is a plan view showing the blank from which the device of FIGS. 1 through 3 is made.

Referring now to the drawings, the combined package, display and dispensing device is formed from a substantially rectangular shaped blank shown in this embodiment comprises three transverse scorelines 4, 6, 8, which define a front main panel 10, a rear main panel 12, a front tab 14 and a rear tab 16. Side flaps 18 and 20 are connected to the front main panel 10 by arcuate scorelines 22 and 24, respectively. Side flaps 26 and 28 are connected to the rear main panel 12 by means of arcuate scorelines 30 and 32, respectively.

The blank is also formed with a window 34 in the front main panel and holes 36, 38 in the front and rear tabs. The window 34 permits access to the material wound on the spool when it is in the package and the holes 36, 38 permit hanging the package when it is assembled and also provide a guide for the material being dispensed from the contained spool.

The blank is folded upon itself along transverse fold line 6 and the mating surfaces of the tabs 14 and 16 are adhered together. In doing so, the holes 36 and 38 join to form a single hole.

The spool S is disposed between the front and rear main panels and projects partly through window 34. One side flap on each side of the package is then folded on its arcuate scoreline so that its outer arcuate edge contacts the inside surface of the opposing main panel. For example, flaps 26 and 28 are folded on their respective arcuate scorelines 30 and 32 until the outer arcuate edges of these flaps engage the inner surface of the front main panel 10. This causes the front and rear panels to bow. Then the side flaps 18 and 20 are folded inwardly on their arcuate scorelines 22 and 24 and they snap into place adjacent the respective flaps 26 and 28. No adhesive is required to hold the side flaps together; of course, adhesive can be used if desired.

It will be seen that the resulting package provides finger gripping surfaces, namely, the concave flaps 18, 20, 26 and 28 at each side of the package. This facilitates handling of the package and helps to avoid accidental dropping and mishandling. In addition, the wire W or other material wound on the spool S is readily accessible through window 34. The wire can be threaded through the holes 36, 38 which then serve as guide holes to permit guiding of the wire by gripping the package either on the spool or on the side flaps 18, 20, 26 and 28. Also, the holes 36, 38 can be used to hang the package for display purposes or storage purposes. A convenient way to use the package is to withdraw wire W from the spool S through the holes 36, 38 and then grip the package with one hand at the spool, for example, with the thumb over the wire W wound on the spool S and the remaining fingers behind the package. This leaves the other hand free for otherwise manipulating the wire or the work on which it is being used.

Having described the package, display and dispensing device and blank therefor as shown in FIGS. 1–4, it will be understood that the invention can take different forms to display and package and dispense any differently shaped and sized spools and other elongate material wound thereon. Additionally, although the term cardboard has been used for purpose of illustration, it will be understood that other materials, such as plastics, paper, etc. may be used as desired. It is to be understood, while we have illustrated and described one form of our invention it is not to be limited to the specific form or arrangements to parts herein described and shown except insofar as such limitations are included in the claims.

What is claimed is:

1. A package and dispensing device for a spool having material wound thereon comprising front and rear panels connected to each other along the top and bottom thereof, a closing flap along each side edge of each said panel and connected thereto by arcuate fold lines, the outer edge of each flap being arcuate, one said flap at each side being folded inwardly on one said arcuate fold line and having its outer arcuate edge engaged against the inside surface of the opposite panel, and the other flap at said side overlying the last mentioned flap, said flaps form concave side walls, at least one of said panels having a window therein, and a spool having material wound thereon positioned between said concave side walls, adjacent said window which permits removal of said material from said spool, said window has a greater length than the axial length of the spool and has a width less than the maximum diameter of the spool to permit projection of a portion of said spool therethrough.

2. Package and dispensing device as claimed in claim 1 including a tab connected to and projecting from at least one of said front and rear panels for carrying identifying information.

3. Package and dispensing device as claimed in claim 1 including a tab connected to and projecting from at least one of said front and rear panels and said tab has a hole for mounting said package and dispensing device.

4. Packaging and dispensing device as claimed in claim 3, wherein said hole is elongate with its longer dimension approximately parallel to the longitudinal dimension of said spool.

5. Package and dispensing device as claimed in claim 1 wherein the material wound on said spool is wire.

6. Packaging and dispensing device as claimed in claim 1, wherein the maximum diameter of the spool is the diameter of the flanges thereof.

7. Packaging and dispensing device as claimed in claim 1, wherein said device is provided with only one said window.

8. Packaging and dispensing device as claimed in claim 1, wherein said concave side walls provide finger gripping surfaces.

9. A blank for a package and dispensing device for a spool having material wound thereon comprising a front panel, a rear panel hingedly connected to said front panel along a main fold line, the edges of said panels opposite said bottom fold line to be connected to each other, a closing flap along each side edge of each said panel and connected thereto by arcuate fold lines, the outer edge of each flap being arcuate, one said flap at each side being adapted to be folded inwardly and having its outer arcuate edge engaging against the inside surface of the opposite panel and the other flap at said side overlying the last mentioned flap, said flaps form concave side walls, at least one of said panels having a window therein to permit accesss to the material wound on said spool, the length of the window is greater than the axial length of the spool and the width of the window is less than the maximum diameter of the spool to permit projection of a portion of the spool therethrough.

10. Blank as claimed in claim 9 wherein said panels are hingedly connected to each other along the bottom thereof and each panel along the top thereof is connected to a tab, the tab of one panel being secured to the tab of the other panel for connecting both said panels.

* * * * *